United States Patent [19]

Katashima

[11] Patent Number: 4,572,273

[45] Date of Patent: Feb. 25, 1986

[54] BLOW PLATE AND/OR BLOW NOZZLE AUTOMATIC CLEANING DEVICE

[75] Inventor: Seiji Katashima, Amagasaki, Japan

[73] Assignee: Naniwa Products Co. Ltd., Osaka, Japan

[21] Appl. No.: 545,544

[22] Filed: Oct. 26, 1983

[51] Int. Cl.[4] ..... B22C 19/00; B22C 23/00

[52] U.S. Cl. ..... 164/158; 164/121; 164/412

[58] Field of Search ..... 164/150, 200, 202, 121, 164/19, 20, 412; 222/166, 198; 15/303, 306 R, 306 B, 310, 316 R; 409/168; 269/71; 51/417

[56] References Cited

U.S. PATENT DOCUMENTS 3,917,249 11/1975 Constantine ..... 269/71

*Primary Examiner*—Nicholas P. Godici
*Assistant Examiner*—C. McKee
*Attorney, Agent, or Firm*—Larson and Taylor

[57] ABSTRACT

A blow plate and/or blow nozzle automatic cleaning device for use in molding machine comprising a blow plate turning, sand-discharging device consisting of a blow plate holding and turning frame which is turned 90° on the fulcrum provided at one end of the lifting frame equipped with the lifting cylinder, and a compressed air injection mechanism which is arranged opposite to the fulcrum side and movable in its horizontal direction.

4 Claims, 7 Drawing Figures

BLOW PLATE AND/OR BLOW NOZZLE AUTOMATIC CLEANING DEVICE

This invention relates to a blow plate and/or blow nozzle automatic cleaning device for use in molding machine.

In the molding operation where there is used sand having a self-curing molding property, such as self-curing molding sand or cold box sand, the remaining sand is cured if it is left for a long period of time, so that the sand remaining within the blow head and the blow nozzle after molding operation must be immediately removed. As things stand today, the remaining sand heaped up on the blow plate dismantled from the blow head is removed with shovel, broom, air duster or the like for the cleaning of the machine, but the sand remaining within the blow nozzle cannot be removed unless air duster is used. In the case of a number of blow nozzles it is troublesome and takes a longer time to carry out a cleaning operation with duster gun for every blow nozzle, and it results in the scattering of sand.

The inventors of this invention have made various studies and experiments to remove the various demerits of conventional systems, and as a result they have succeeded in developing a blow plate and/or blow nozzle automatic cleaning device for use in molding machine. The subject matter of the present invention resides in a blow plate automatic cleaning device for use in molding machine comprising a blow plate holding and turning frame which is turned on the fulcrum provided at one end of a lifting frame equipped with a lifting cylinder; and a blow plate and/or blow nozzle automatic cleaning device for use in molding machine comprising a blow plate turning, sand-discharging device consisting of a blow plate holding and turning frame which is turned 90° on the fulcrum provided at one end of a lifting frame equipped with a lifting cylinder, and a compressed air injection mechanism which is arranged opposite to said fulcrum side and movable in its horizontal direction.

According to the blow plate and/or blow nozzle automatic cleaning device of the invention, by the above construction it is possible to collect the remaining sand on the blow plate into the lower-positioned sand box in a shorter period of time without needing much labor, and by using the cleaning nozzle disposed correspondingly to the arranging position of the blow nozzle at the surface of a blow plate cleaning plate it is possible to completely remove the remaining sand with a single operation for the cleaning of a plurality of nozzles. This is a success for the shortening of the cleaning work of remaining sand and for the improvement of working environment and labor saving.

The constitution of the invention will now be described more in detail, by way of examples, with reference to the accompanying drawings.

Figure 1:
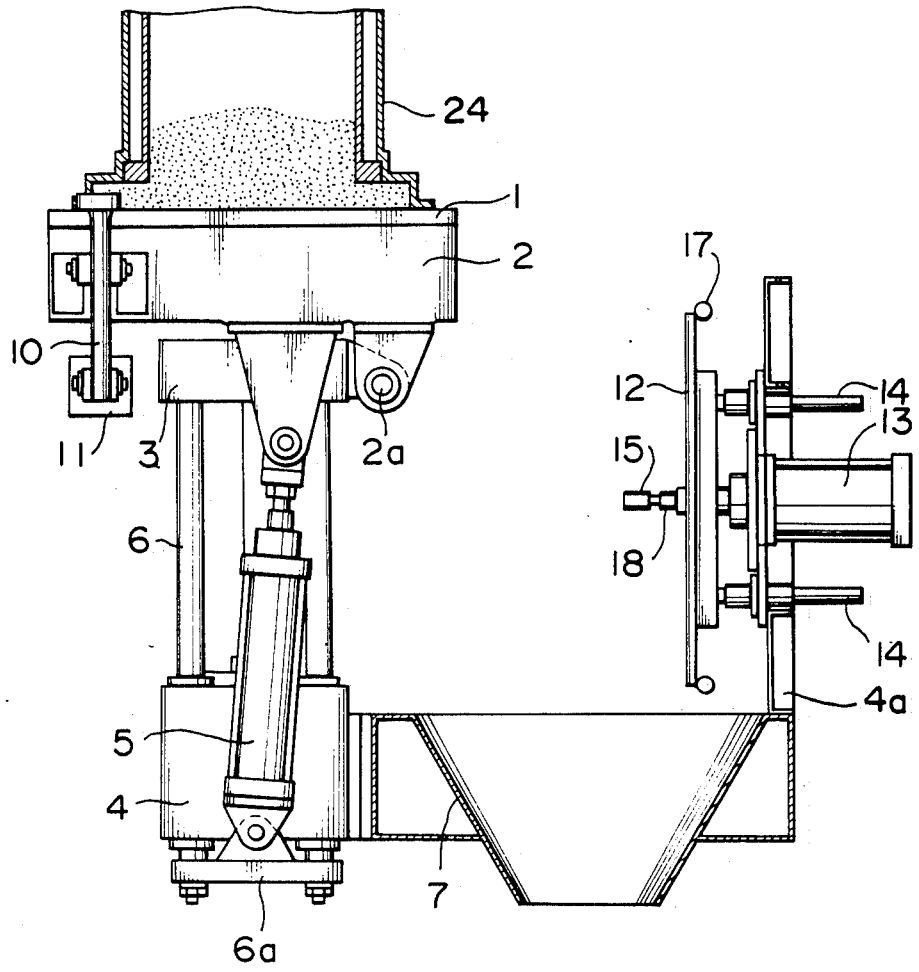
FIGS. 1, 2 and 4 are elevational views in section which show the sequence of removing the sand on the blow plate in the present device.

FIGS. 1 to 6 describes in order one operational mode of the cleaning device of this invention. In these drawings, reference numeral 1 designates a blow plate which is detachably mounted to a blow head 24 as is known. Reference 2 is a turning frame which is provided, approximately as shown in the drawings, with a plurality of respective blow plate holding hooks 10 and cylinders 11 for said holding hooks. Reference 3 is a lifting frame, it is supported by a plurality of lifting guide bars 6 inserted through a fixed frame 4 and by a lifting cylinder 9 provided in said frame 4, and it is raised or lowered by the operation of the lifting cylinder 9.

Said turning frame 2 is pivotally mounted in such a manner that it is turned more than a degree in which the sand on the blow plate may fall down on a fulcrum 2*a* provided at one end (the compressed air injection mechanism side referred to below) of the lifting frame 3, for example 60° to 90°, and the turning operation is carried out by the actuation of a turning cylinders 5. The device shown in the drawings decribes an example in which said turning cylinders 5 are mounted to a connecting plate 6*a* of the lifting bars 6, but said turning cylinders can be optionally positioned without being limited to the above position.

With the provision at the fulcrum 2*a* side for pivotally mounting the turning frame of the fixed frame 4 and at intervals necessary for a 90° turn of said turning frame 2, the compressed air injection mechanism disposed opposite to the blow plate automatic sandremoving, cleaning device is constructed as follows. Numeral 12 designates a blow plate cleaning plate at which are vertically provided a plurality of cleaning nozzles 18 which at least correspond with the number of said blow nozzles 16 arranged in the blow plate 2, and an end rubber 15 is fitted in the end portion of each of said cleaning nozzle 18. Said blow plate cleaning plate 12 is fixed to the cylinder rod end portion of a push-out cylinder 13 of the blow plate cleaning plate, said cylinder 13 being arranged in a vertical portion 4*a* of the fixed frame, and by the actuation of said cylinder 13 the guide bars 14 slide to advance or retract the blow plate cleaning plate 12.

Further, in the drawings, reference numeral 7 indicates a sand discharging shute provided in the extension portion of the fixed frame, being arranged directly under the turning position of said turning frame 2, and reference 8 designate a sand discharging box.

The cleaning device of the invention is constructed as described above, but the automatic cleaning operation of the blow plate and/or blow nozzle according to the present device are explained below.

When removing the remaining sand within the blow head 24, the lifting cylinder 9 is actuated to raise the lifting frame 3 and the turning frame 2 until the frame 2 comes to a close contact with the lower surface of said blow plate 1, in order that as shown in FIG. 1 the blow plate attached to the blow head 24 of the molding machine is dismantled. Then the blow plate 1 is removed from the blow head 24 of the molding machine, when it is placed on the turning frame 2, and the blow plate holding hook cylinder 11 is actuated so that the blow plate 1 may be held at the turning frame 2 by the blow plate holding hooks 10.

Figure 2:
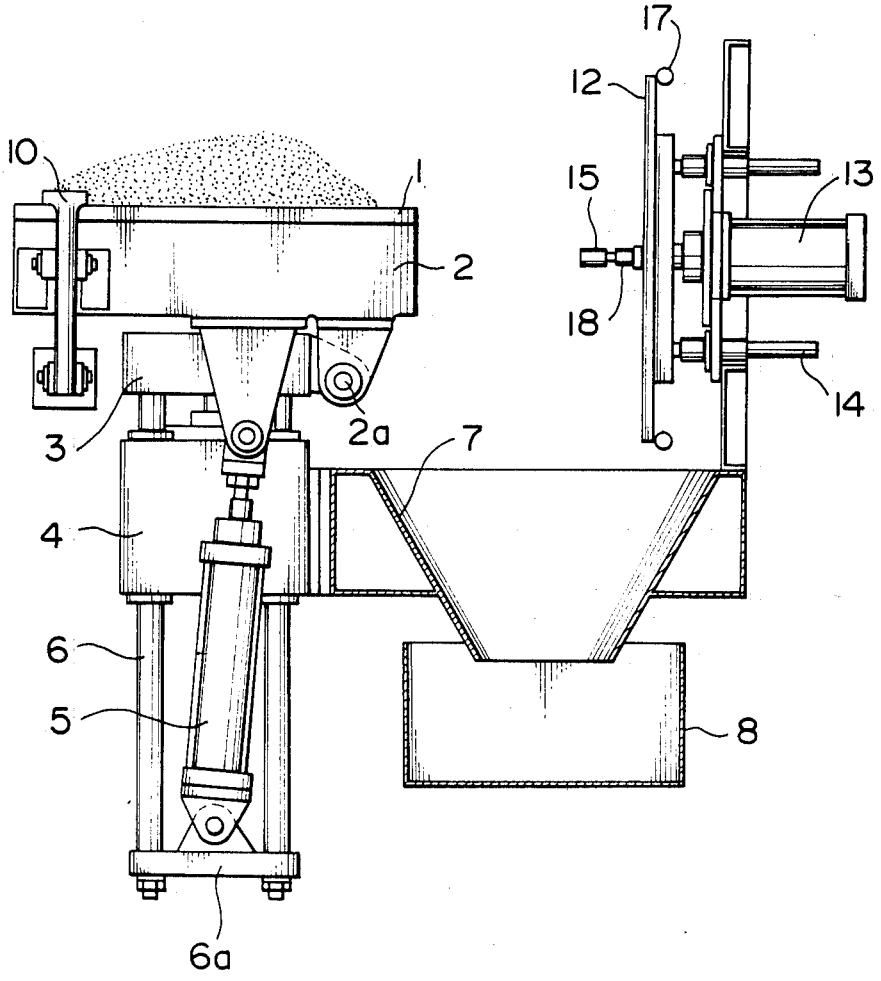
Figure 3:
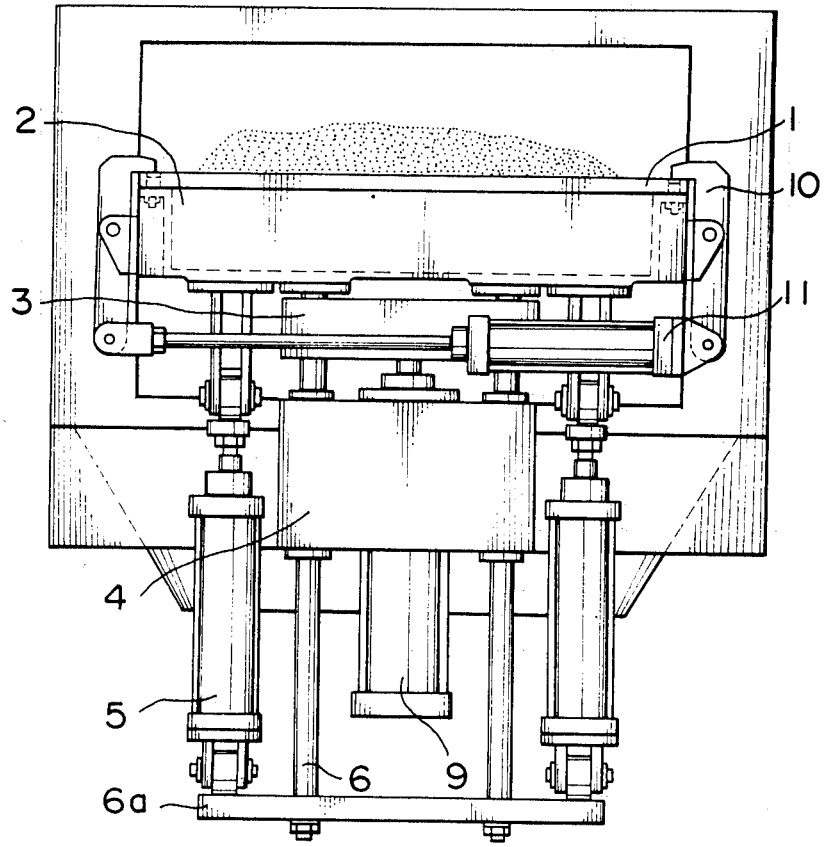
FIG. 3 is a side view of the cleaning device in the state shown in FIG. 2.

The lifting cylinder 9 is then operated (see FIG. 3) at the state shown in FIG. 1 thereby to lower the blow plate 1 to its cleaning position (see FIG. 2). That is, as shown in FIG. 2, the remaining sand within the blow head 24 is taken out in the cleaning position by being placed on the upper surface of the blow plate 1. When the turning cylinders 5 are operated the blow plate 1 held by the turning frame 2 is turned 90° as shown in FIG. 4 whereby all the remaining sand on the blow plate 1 falls for collection down into the sand discharging box 8 provided beneath the sand discharging shute 7.

Additionally, in case only the sand on the blow plate is removed even about 60° of said turn will be sufficient for the discharge of the sand.

The remaining sand of the blow plate 1 is removed by said operation, but such operation is still insufficient for the removing of sand remaining in the blow nozzle 16 (usually in plurality) provided in the blow plate 1. Accordingly, in the present device the remaining sand in the blow nozzles 16 is completely removed by means of a compressed air injection mechanism which is disposed opposite to the turned blow plate 1 and movable in its horizontal direction, and the operational mode of said injection mechanism is described now.

Figure 4:
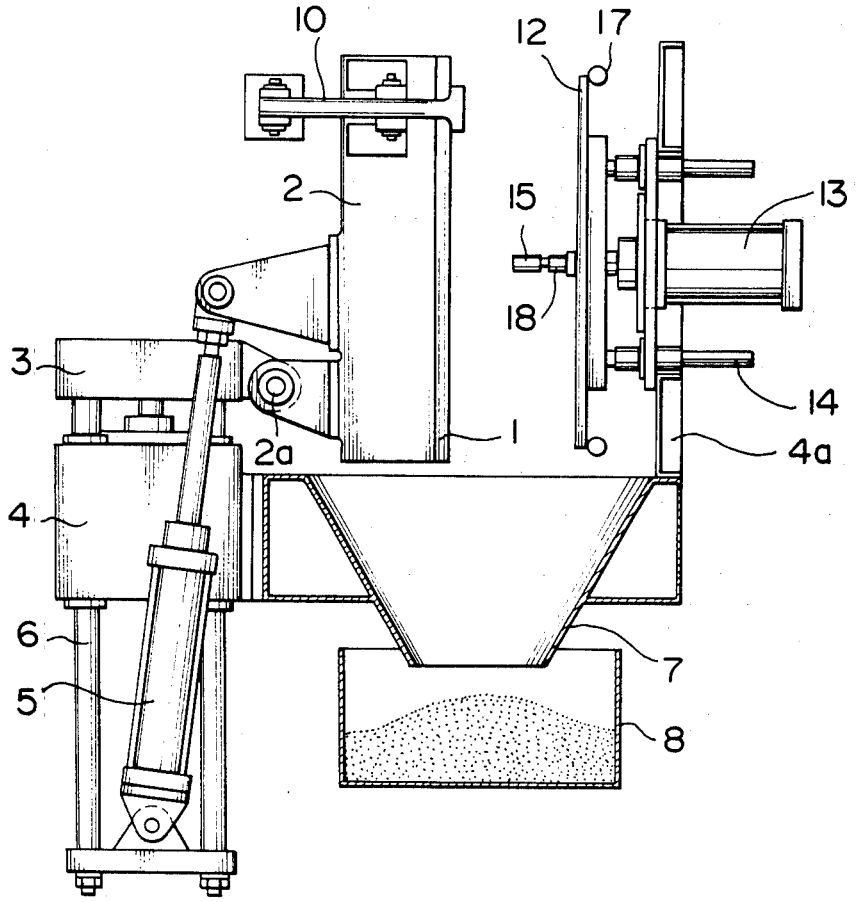
Figure 5:
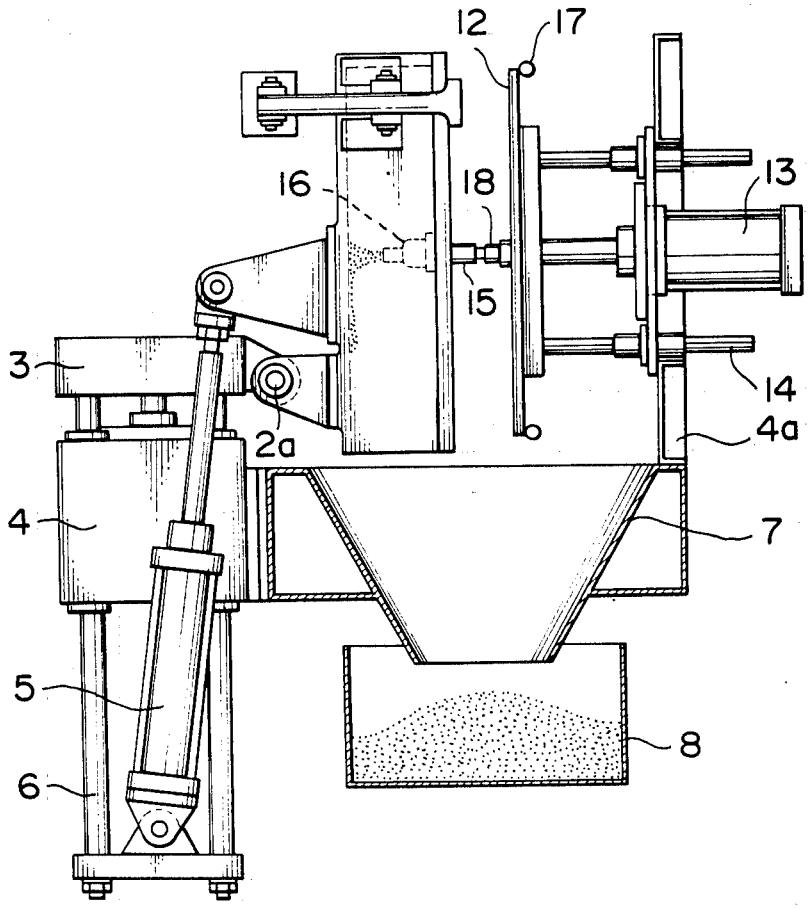
FIG. 5 is a front view which shows the condition of cleaning the blow nozzle.
Figure 6:
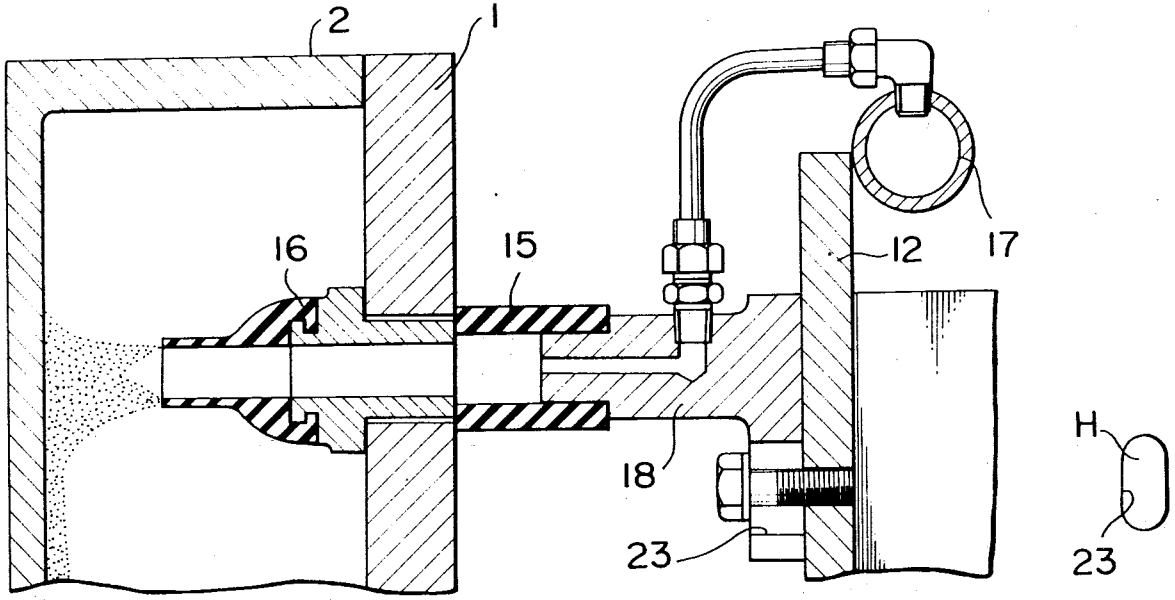
FIG. 6 is a detail sectional view of the cleaning nozzle.

While gradually advancing said cleaning plate 12 by actuating the blow plate cleaning plate push-out cylinder 13 at the state shown in FIG. 4 a compressed air is injected from the cleaning nozzles 18 (which are fitted with the end rubber 15), when even a small amount of sand remaining adhered to the surface of the blow plate 1 is completely removed by the injected air. If the cleaning plate 12 is further advanced and the compressed air is continued for injection by closely contacting the end rubber 15 of the cleaning nozzles 18 to each blow nozzle 16 of the blow plate 1 as shown in FIG. 5, the remaining sand within the blow nozzles 16 is quickly and completely discharged into the sand discharging box 8 as shown in FIG. 6. It is added that in the case of a blow plate wherein the position of the blow nozzles 16 is a little different in the present device it is possible to conform the cleaning nozzles 18 to the blow nozzles 16 by somewhat displacing said cleaning nozzles by making bolt holes 23 for mounting the cleaning nozzles an elongated hole H as shown in FIG. 6.

Figure 7:
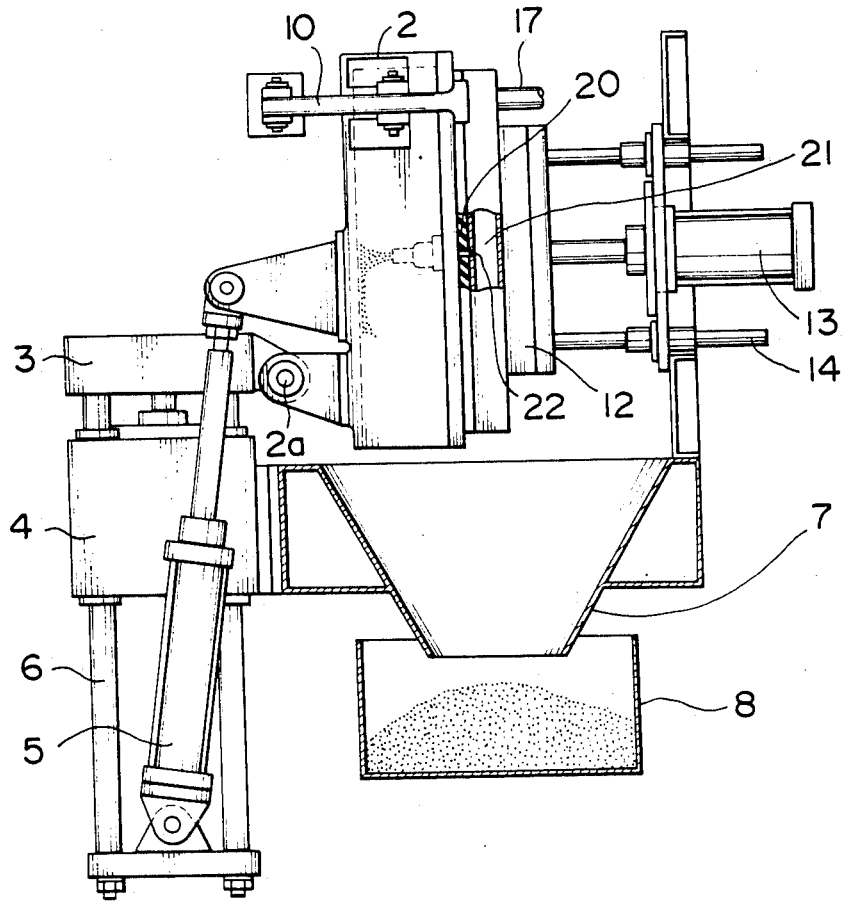
FIG. 7 is a detail sectional view in the case of a cleaning jacket.

FIG. 7 is a fragmentary sectional view which shows another operational mode of the invention, in which instead of said cleaning nozzles, a cleaning jacket 21 and a flexible plate 20 such as rubber plate are attached to the blow plate cleaning plate 12. The cleaning jacket 21 communicating with an air intake piping 17 is bored with an air dust hole 22 at the same position as a rubber plate 20. The operational method in this embodiment is same as in the above case, but with this system, unlike said example it is not required to adjust the position by bolts if the air dust hole 22 is additionally bored even if the blow nozzles are differently positioned, and even in the case of blow plate of different arrangements (plurality) of said blow nozzles 16 they can be used in common.

Additionally, though not shown, it is also capable of dividing the circuit of the air supplied to said cleaning nozzles 18 into a plurality of systems thereby to remove in order the remaining sand within the blow nozzle in each division. That is, in case there are many blow nozzles 16 a great amount of air is needed simultaneously to blow out the air therein at the same time. Accordingly, the air pressure is greatly lowered and the injection power of the air is weakened so that it is possible to make an efficient cleaning without weakening the injection power by supplying air in regular succession into respective divisions.

Being constituted as described above in detail, according to the present device, it is capable of thoroughly remove automatically and in a shorter period of time the sand remaining in both the blow head and blow nozzles, and the sand is not scattered, and therefore in the working environment and labor saving there can be yielded distinctive function and effect which can not be obtained from conventional systems. Moreover, it is possible, according to the present device, to replace blow plate efficiently and in a shorter period of time, which is necessitated by the replacement of mold.

What is claimed is:

1. A blow plate and/or blow nozzle automatic cleaning device for use in a molding machine having a blow plate and/or blow nozzle comprising:

a blow plate turning and sand discharging device consisting of
- (a) a fixed frame,
- (b) a lifting frame,
- (c) a lifting cylinder means attached to said fixed frame and said lifting frame for vertically lifting said lifting frame relative to said fixed frame,
- (d) a turning frame located above said lifting frame,
- (e) a fulcrum means for mounting said turning frame to one side of said lifting frame for 90° turning of said turning frame relative to said lifting frame, and,
- (f) a blow plate holding means attached to said turning frame for releasably holding the blow plate to said turning frame;

a compressed air injection mechanism arranged adjacent to said one side of said lifting frame; and a moving means for moving said compressed air injection means horizontally toward said one side of said lifting frame whereby after said lifting frame is lifted and the blow plate is held to and turned with said turning frame, said compressed air injection mechanism is moved toward the blow plate to completely clean the blow plate.

2. A blow plate and/or blow nozzle automatic cleaning device for use in a molding machine as set forth in claim 1 wherein the compressed air injection mechanism consists of a blow plate cleaning plate which is embedded vertically with two or more cleaning nozzles equipped with rubber ends, and wherein said moving means includes a cylinder for driving said cleaning plate.

3. A blow plate and/or nozzle automatic cleaning device for use in a molding machine as set forth in claim 1 wherein the compressed air injection mechanism consists of a cleaning jacket which is provided with a flexible plate at the air injection surface and with an air dust hole, and wherein said moving means includes a cylinder for driving said cleaning jacket.

4. A blow plate and/or blow nozzle automatic cleaning device for use in a molding machine as set forth in claim 2 wherein a circuit is provided for supplying air into the cleaning nozzles which circuit is divided into a plurality of systems.

* * * * *